United States Patent [19]

Chen

[11] Patent Number: 5,003,694

[45] Date of Patent: Apr. 2, 1991

[54] FLEXIBLE RAZOR HEAD

[75] Inventor: Evan N. Chen, Fairfield, Conn.

[73] Assignee: Warner-Lambert Company, Morris Plains, N.J.

[21] Appl. No.: 507,272

[22] Filed: Apr. 10, 1990

Related U.S. Application Data

[63] Continuation-in-part of Ser. No. 353,840, May 18, 1989, which is a continuation of Ser. No. 115,781, Oct. 30, 1987, Pat. No. 4,854,043.

[51] Int. Cl.[5] ..... B26B 21/16

[52] U.S. Cl. ..... 30/49; 30/32; 30/50

[58] Field of Search ..... 30/32, 47–50, 30/84, 90

[56] References Cited

U.S. PATENT DOCUMENTS

| | | | |
|---|---|---|---|
| 4,443,939 | 4/1984 | Motta et al. | 30/49 |
| 4,516,320 | 5/1985 | Peleckis | 30/49 |
| 4,720,917 | 1/1988 | Solow | 30/49 |

*Primary Examiner*—Douglas D. Watts

*Attorney, Agent, or Firm*—Daniel A. Scola, Jr.

[57] ABSTRACT

A flexible razor head is provided which features a flexible cap and seat. Corrugations, having portions of different widths, present in the seat enhance the ability of the seat to lengthen in response to shaving forces.

47 Claims, 9 Drawing Sheets

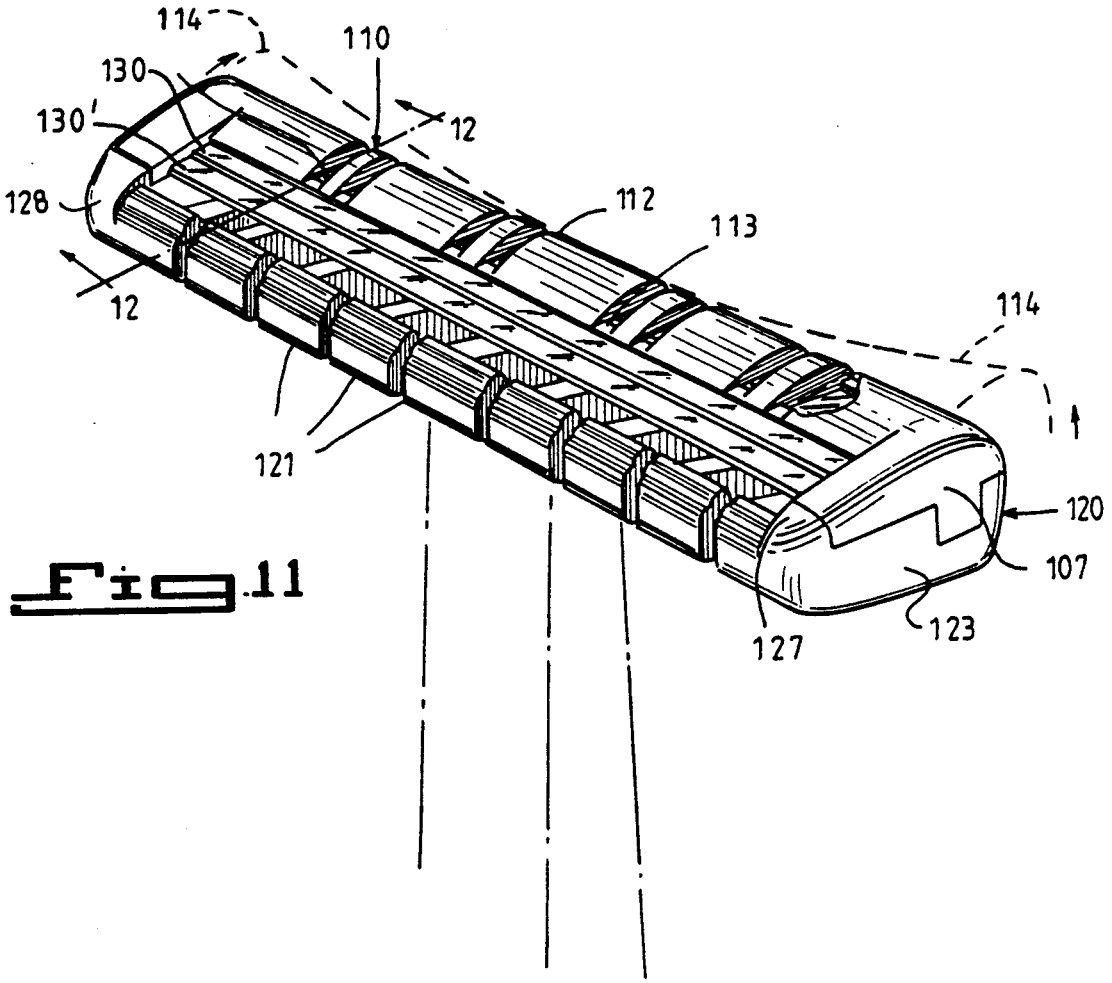
Fig. 11
Fig. 12
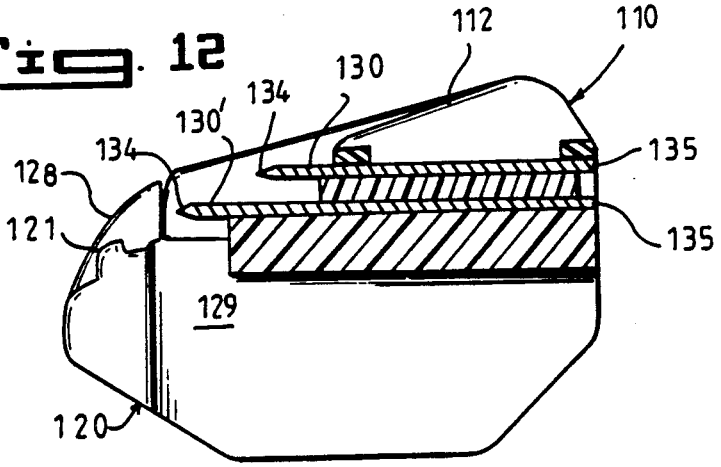

FLEXIBLE RAZOR HEAD

FIELD OF THE INVENTION

This invention relates to a razor head and, in particular, to a flexible razor head which flexes in response to normal shaving forces.

BACKGROUND OF THE INVENTION

This application is a Continuation-in-Part of Ser. No. 353,840 filed on May 18, 1989, which is a Continuation of Ser. No. 115,781 which issued as U.S. Pat. No. 4,854,043 on Aug. 8, 1989.

Recently several razors have featured razor heads designed to be dynamically movable in response to various forces exerted during shaving. An example of such a razor head is the pivoting cartridge sold under the trademark ULTREX by the Schick Safety Razor Group of the WarnerLambert Company. Such a cartridge pivots about fixed pivot points provided by a handle in response to razor movement during shaving.

The term "razor head" as used herein refers to the combination of a cap, a seat having a guard bar extending outwardly therefrom, and either a single blade or a combination of two blades separated by a spacer. The term "razor head" as used herein includes both disposable razors wherein the cap, seat, blade(s) and handle are unitary and a cartridge per se which is typically used with a permanent handle.

Several patents to Jacobson, e.g. U.S. Pat. No. 4,446,619, feature the individual spring mounting of blades and, additionally, in some instances, a guard bar to provide vertical movement in response to shaving forces. The blades and guard bar are designed to move up and down within the razor cartridge during shaving. The cap in the Jacobson configurations provides a limiting feature for travel of the uppermost blade in the two blade system and is fixed to the remaining, non-movable parts of the cartridge. The Jacobson concept, however, does not take into account the configuration of the face which tends to be made up of a flexible series of arcs and angles, rather than separate distinct planes.

Other examples of dynamic shaving are found, for example, in U.S. Pat. No. 4,443,939 issued to Vincent C. Motta and Ernest F. Kiraly on Apr. 24, 1984. This razor head configuration discloses a razor cap having corrugated segments disposed on either side of the cap center as well as a guard bar which is individually segmented and a seat portion of the blade support structure from which the guard bar depends having a convoluted, cage-like structure. The spacer in this two blade system has cut out areas to increase flexibility and the blades feature extended longitudinal slots.

The Motta patent describes suspending the cartridge by keyholes provided in the blade support portion and matching key-like projections extending from a handle. The pin means depending downward from the cap of Motta was designed to maintain the individual elements of the razor head in a predetermined configuration. To this end, a snug fit for the pin means was provided in which a necked-in portion of the pin means is positioned between an enlarged lower portion and an enlarged upper portion. The lower portion cross-sectional diameter is somewhat larger than the receiving holes in the blade support portion. The holes are, however, chamfered to provide sufficient flexibility for the pins to be "fit snugly" with a bulbous bottom end of the pins passing through the chamfered hole and providing an anchoring site.

Another approach for the design of a flexible razor head is found in U.S. Pat. No. 4,069,580 issued Jan. 24, 1978, which reissued as patent no. Re 30,913 on Apr. 27, 1982, and U.S. Pat. No. 4,409,735 to Cyril A. Cartwright, et al. This dynamically flexible razor head features an assembly in which the head components are held together either by adhesive strips contacting each of the elements or, in the embodiment depicted in FIG. 7, the blades are inserted into a premolded razor head with slots. The Cartwright embodiment depicted at FIG. 7 shows a fingered cap with the fingers being separated by spaces coinciding with spaces separating ribs of blade support portions for the bottom-most blade in a two-blade system. The blades are inset into mating slots in this particular embodiment. The razor head of Cartwright is also suspended by pins in much the same way as the razor head described in Motta.

Another example of a razor having dynamically movable elements is described in U.S. Pat. No. 4,516,320 issued to Anthony J. Peleckis in which the razor blade assembly is supported only at each end, and therefore deflects in response to shaving forces while the guard bar moves backward and upward due to certain constructional features.

Each of these razor systems wherein the razor head is movable suffers from some disadvantage. The pin and receptacle arrangements used to connect the cartridge and handles in the Cartwright and Motta designs are difficult to assemble and may tend to fall off in response to conventional shaving forces. Moreover, in the case of the Motta design, flexibility is inhibited because the seat, including the guard bar, and the cap flex at different flex points. This tends to inhibit the overall flexibility of the razor head.

In the case of the design shown in FIG. 7 in the Cartwright patents, both the cap and seat have open areas which are aligned with each other but the blades are inhibited from free movement by the clamping associated with the slots formed for them in the one piece cap and support structure. The use of relatively thick support ribs also tends to inhibit flexibility.

SUMMARY OF THE INVENTION

According to the present invention, a flexible razor head is provided which features a flexible cap and a seat having a segmented guard bar. Corrugations present in the seat enable the seat to lengthen in response to shaving forces. The corrugations are advantageously aligned with the open spaces or areas of reduced thickness in the cap. The force required to lengthen the blade support portion is reduced by providing an improved corrugation design to at least one of the corrugations.

BRIEF DESCRIPTION OF THE DRAWINGS

The invention can be more readily understood by reference to the drawings in which:

FIG. 11 is a perspective view of the assembled razor head of an alternative embodiment of the present invention; and FIG. 12 is a cross-sectional view taken along lines 12—12 of FIG. 11.

DETAILED DESCRIPTION OF THE INVENTION

Figure 1:
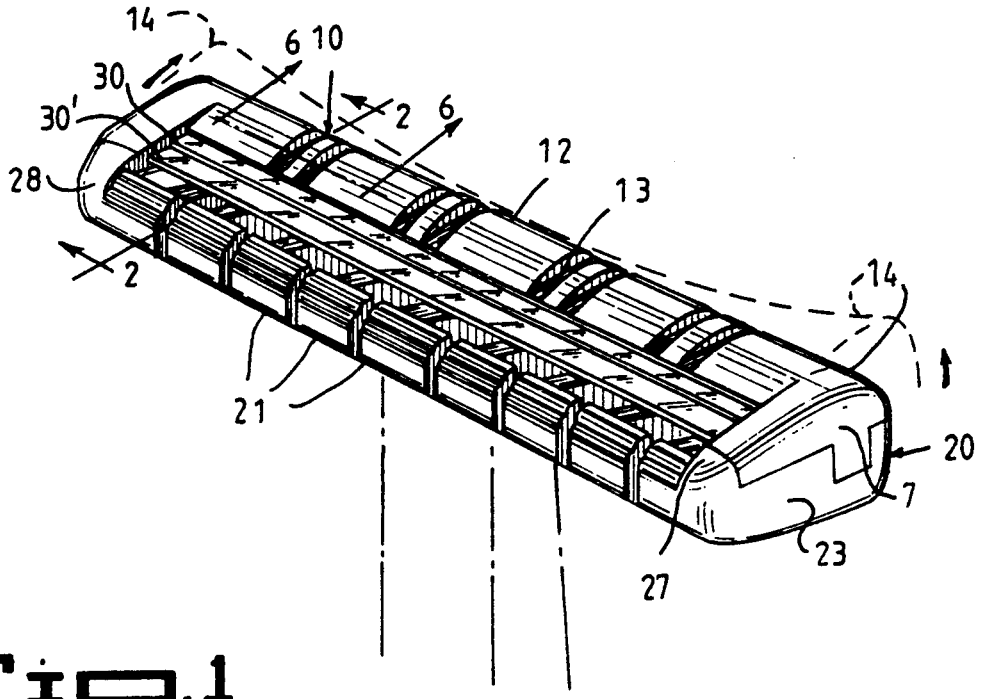
FIG. 1 is a perspective view of the assembled razor head of one embodiment of the present invention.
Figure 3:
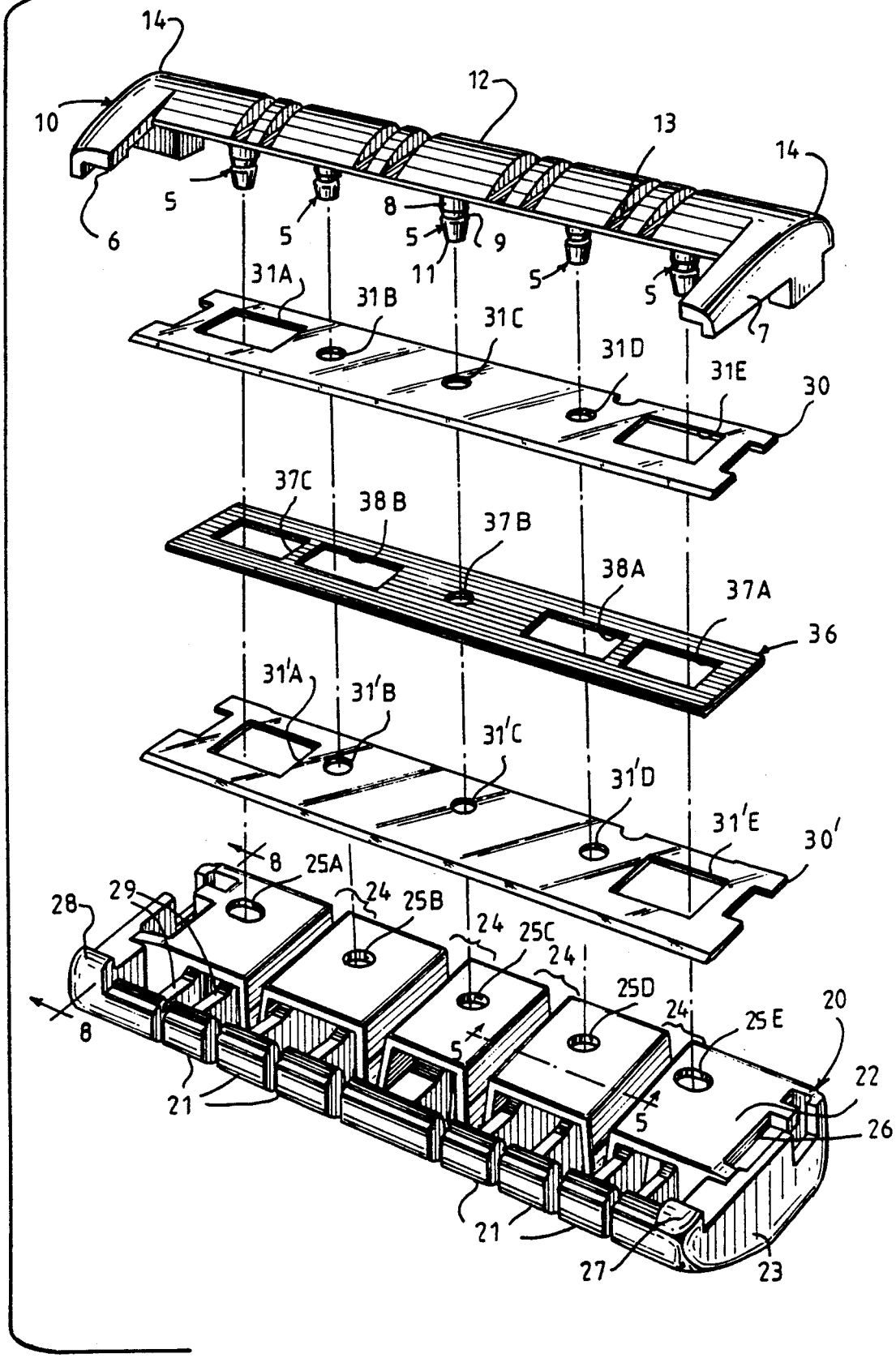
FIG. 3 is an exploded perspective view of the razor head of one embodiment in the present invention.
Figure 4:
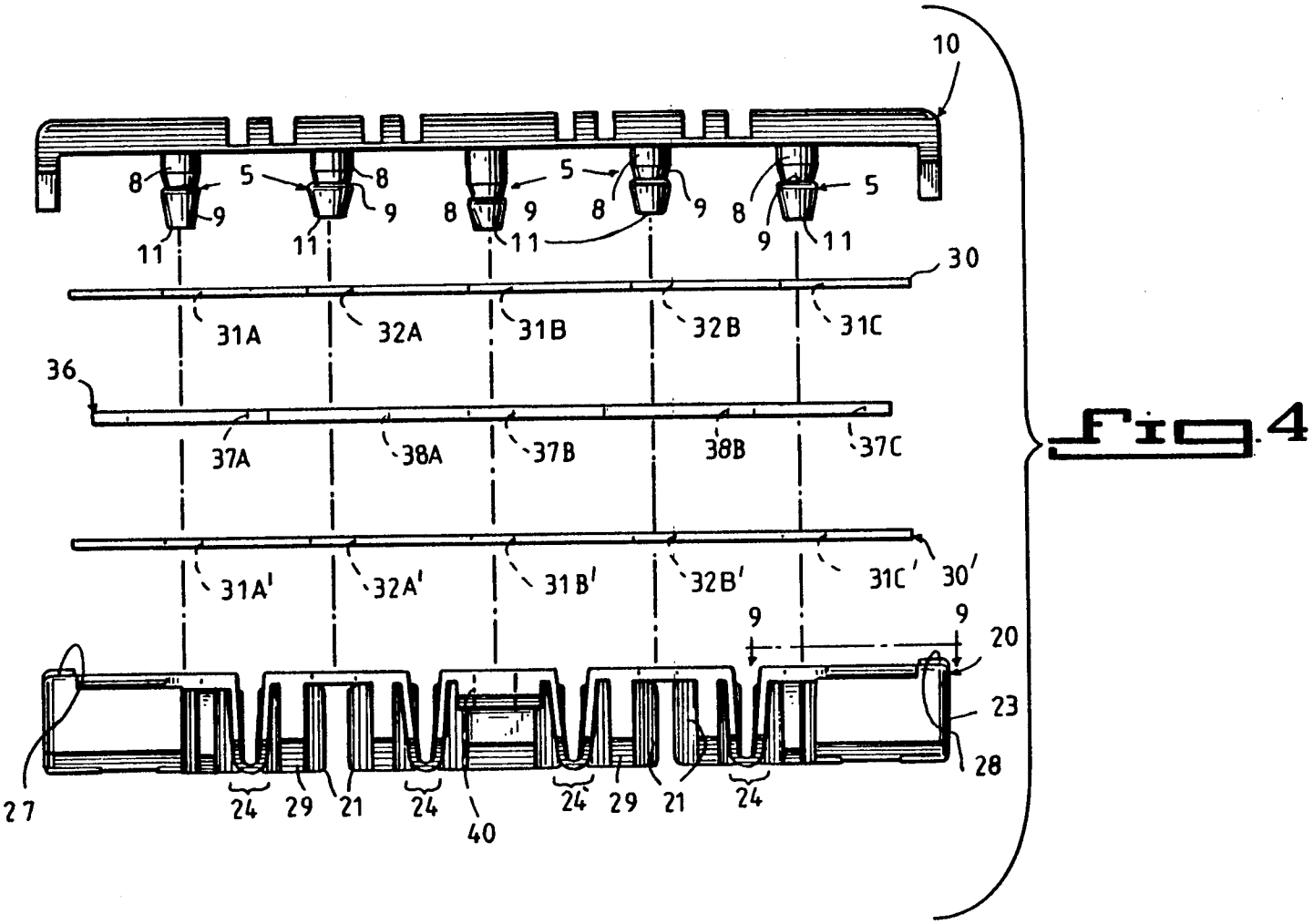
FIG. 4 is an exploded, rear elevational view of the razor according to one embodiment of the present invention.

As can be seen by reference particularly to FIGS. 1, 3 and 4, the razor head of one embodiment of the present invention includes cap 10, seat 20, blades 30, 30', and spacer 36. While the configuration shown at FIG. 3 includes two blades and a spacer, increased flexibility may be obtained using an alternative embodiment of the present invention which utilizes only one blade. It will be appreciated by those skilled in the art that a certain trade off exists between the closeness of the shave encountered with two blades and the increased flexibility associated with one blade. As a result, the choice between these configurations is one based upon economics and shaver preference.

Figure 2:
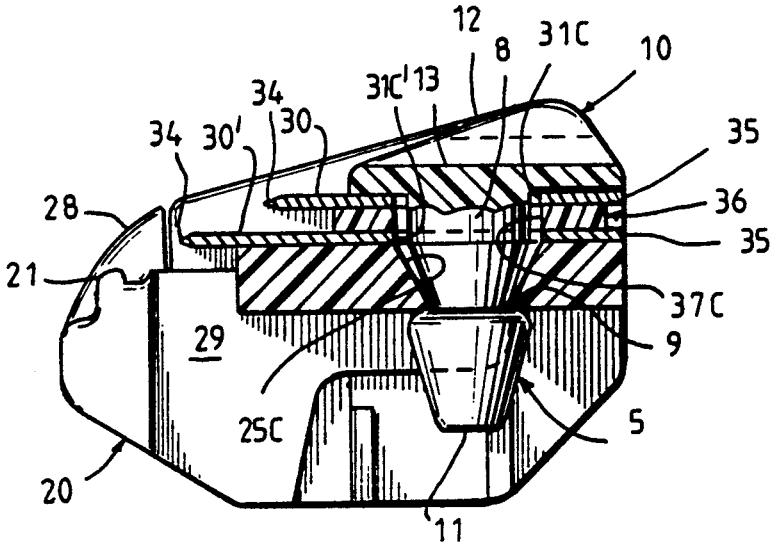
FIGS. 2 is a cross-sectional view taken along the line 2—2 of FIG. 1.

The cap 10, of the embodiment shown in FIGS. 1, 2 and 4, features raised areas 12 and open areas 13. The open areas may be partially recessed as in the illustrated embodiment or may have alternative designs. For example, the open areas may comprise holes which extend entirely through the cap 10 leaving only a narrow portion of the cap to connect adjacent raised areas. FIGS. 11 and 12 illustrate an alternative embodiment of the present invention wherein open areas 113 are provided with generally rectangular holes which extend through cap 110. Open areas increase the flexibility of the cap 10. Throughout the specification, the term "open area" is used generically for all of these variations.

The cap 10 is also provided with raised end areas 14 having end sides 7. The inside surface 6 of cap 10 is designed to mate with raised ends 26 of the seat 20. Upon assembly, side 7 of cap 10 and side 23 of seat 20 form a continuous side surface which acts not only to protect the user from gouging by the blade sides but also forms a barrier to help limit the relative shifting of the blades 30, 30' in a lateral direction.

As can best be seen by reference to FIGS. 3 and 4, cap blade 30 and seat blade 30' are virtually identical in configuration, although the seat blade 30' is wider and extends further forward as illustrated in FIG. 2.

Each blade features five pin receiving holes 31A–E, 31'A–E. The outer holes 31A, 31E, 31A', 31E' of each blade is preferably in the form of a slot to enhance the flexibility of the blades by allowing the lateral movement of the blades relative to the outer pins. In the preferred five pin embodiment, all holes other than the center holes are preferably larger than shafts 8 of pins 5 to allow movement relative to the pins 5.

As shown in FIG. 3, the seat 20 includes flat surfaces 22 upon which seat blade 30' rests, a segmented guard bar 28 attached to the flat surface 22 by ribs 29, and chamfered receiving holes 25A–E. These holes receive pins 5 of cap 10 which each have bulbous ends 11, frustoconical portions 9, and generally cylindrical shaft portions 8.

Figure 6:
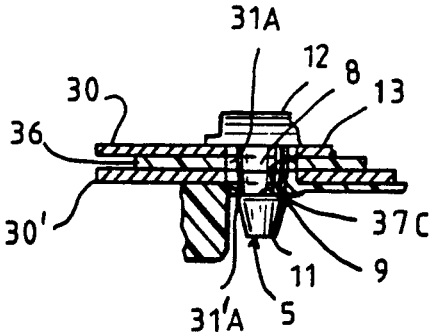
FIGS. 6 and 7 are partial cross-sectional views of the razor head of FIG. 1 taken along line 6—6 of FIG. 1.
Figure 7:
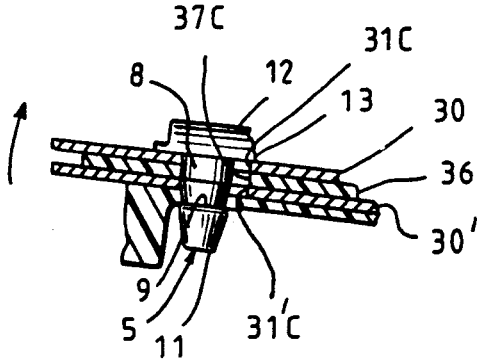

As illustrated in FIGS. 6 and 7, the pins 5 extend downwardly securing the blades 30, 30' and spacer 36 between cap 10 and seat 20 while allowing the blades to slide laterally on shaft portions 8 of pins 5. FIG. 6 illustrates a razor of the present invention in an unstressed configuration wherein a pin 5A is substantially centrally located within slot 31A. FIG. 7 is a view of the same portion of a razor head of the present invention wherein the razor head is subject to a bending force such as a force applied by a contour of the face during shaving. As illustrated in FIG. 7, when the razor head is in this flexed position, the outer edges of the blade are drawn inwardly more than the corresponding portions of the cap 10 so the pin 5A is disposed on the left side of pin opening 31A. Thus, by forming the outer holes of the blades 30, 30' and spacer 36 larger than the diameter of shaft portions 8 of pins 5, lateral movement of these elements relative to the pins is permitted during the flexing of the razor.

The illustrated embodiment of the present invention advantageously utilizes five pins 5 to secure cap 10 to seat 20. While those skilled in the art will appreciate that the use of fewer pins is possible, in light of the high degree of flexibility inherent in the design of each element, it is preferable to use five pins to maintain the blade geometry between the seat, blade(s), and cap at all locations on the razor head. The blade geometry is the proper positioning of the blade(s) relative to the guard bar and cap. The pins 5 are preferably equally spaced and one of the pins is preferably centrally located on the razor head.

Figure 13:
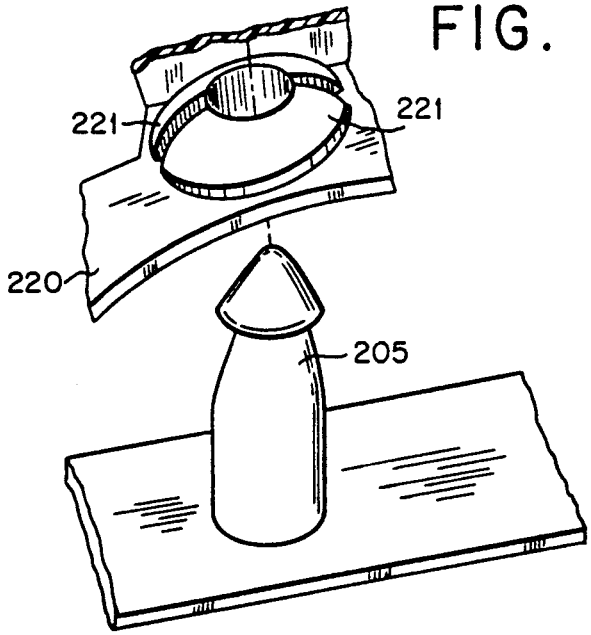
FIG. 13 is a perspective view of an alternative embodiment of the present invention illustrating a snap-fit between the cap and seat.
Figure 14:
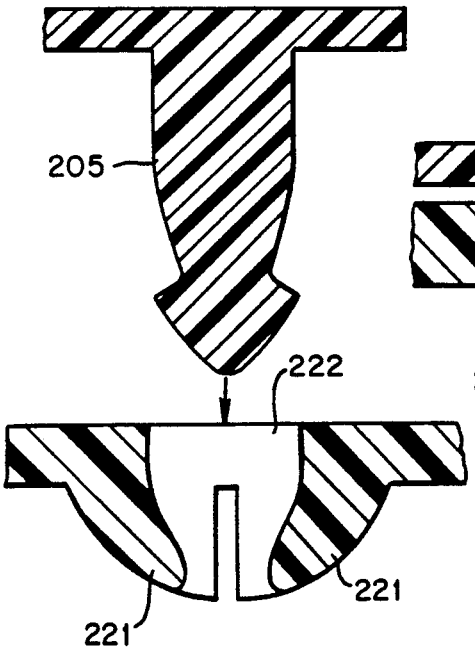
FIGS. 14 and 15 are cross-sectional views of the embodiment illustrated in FIG. 13.
Figure 15:
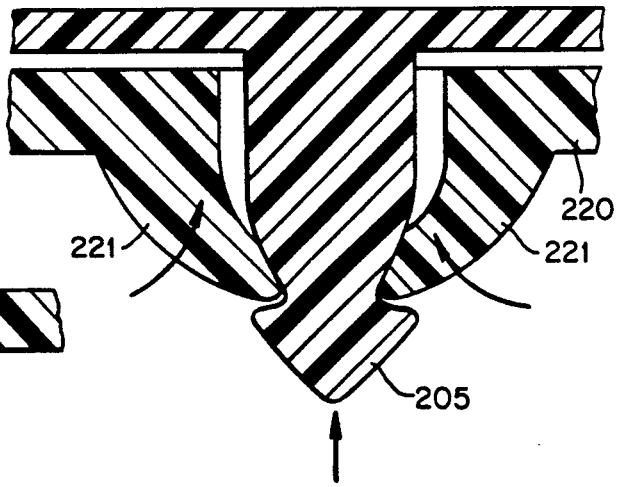

In an alternate embodiment, shown in FIGS. 13–15, the seat 220 is designed to provide a snap-fit with pins 205. As illustrated, the bottom of seat 220 is provided with a pair of resilient locking members 221 adjacent each of holes 222. The locking members 221 are preferably curved in the horizontal plane to more closely conform to the generally round shape of the pins 205. The locking members 221 are also preferably angled inwardly, as shown in the cross-sectional view of FIG. 15, from locations on the base of seat 220 to the location where the locking members 221 engage the pin 205. As illustrated by the arrows in FIG. 15, an upwardly-directed force on pin 205 results in an inwardly-directed force on locking members 221 in this embodiment. This embodiment of the present invention is not limited to the embodiment illustrated in FIGS. 13–15. Those skilled in the art will appreciate that the locking members may be utilized for less than all of the pin-receiving holes and may be shaped differently while providing the intended benefits.

In still another embodiment, the pin and receiving hole arrangement is eliminated by molding all elements other than the blade(s) in a single molding operation. Thus, the supports above and below the blade(s) are actually a single unit joined by plastic which has flowed through and/or around the blade(s) at least at one point.

With reference to FIG. 2, each blade has a rear edge 35 and a forwardly projecting shaving edge 34. As can be seen, the shaving edge of the upper or cap blade 30 does not project as far forwardly as the shaving edge 34 of the seat blade 30'. This arrangement is well known in the art.

FIG. 4 is an exploded, rear-elevational view of the razor head illustrated in FIG. 3. The location of the corrugations 24 on the rear side of seat 20 is illustrated in FIG. 4. As illustrated, the pins 5 of cap 10 preferably have different lengths. The central pin has a longer cylindrical portion 8 than the other pins in order to properly seat center pin 5 within the corresponding support portion 40 of seat 20. As can be seen from FIG. 4, the center support section 40 of the illustrated embodiment of seat 20 has a greater thickness than the support portions adjacent the other four holes. The greater thickness of support portion 40 serves to facilitate the proper alignment of the cap 10 on the seat 20 and to maintain the blade geometry.

The bottom of the central pin extends further than the bottoms of the other pins and preferably at least as far as the bottom curved portions 50 of corrugations 24. This extension of the central pin is particularly adapted to abut a slidable cartridge support of a razor mechanism which may be used to assist returning the razor head to a linear configuration after it has been deflected during shaving. According to the present embodiment of the present invention, the other pins are not extended as far downwardly, but they could be so extended without departing from the scope of the present invention. The remaining pins 5A–B, 5D–E are similarly designed to engage their corresponding support portions in seat 20.

Figure 5A:
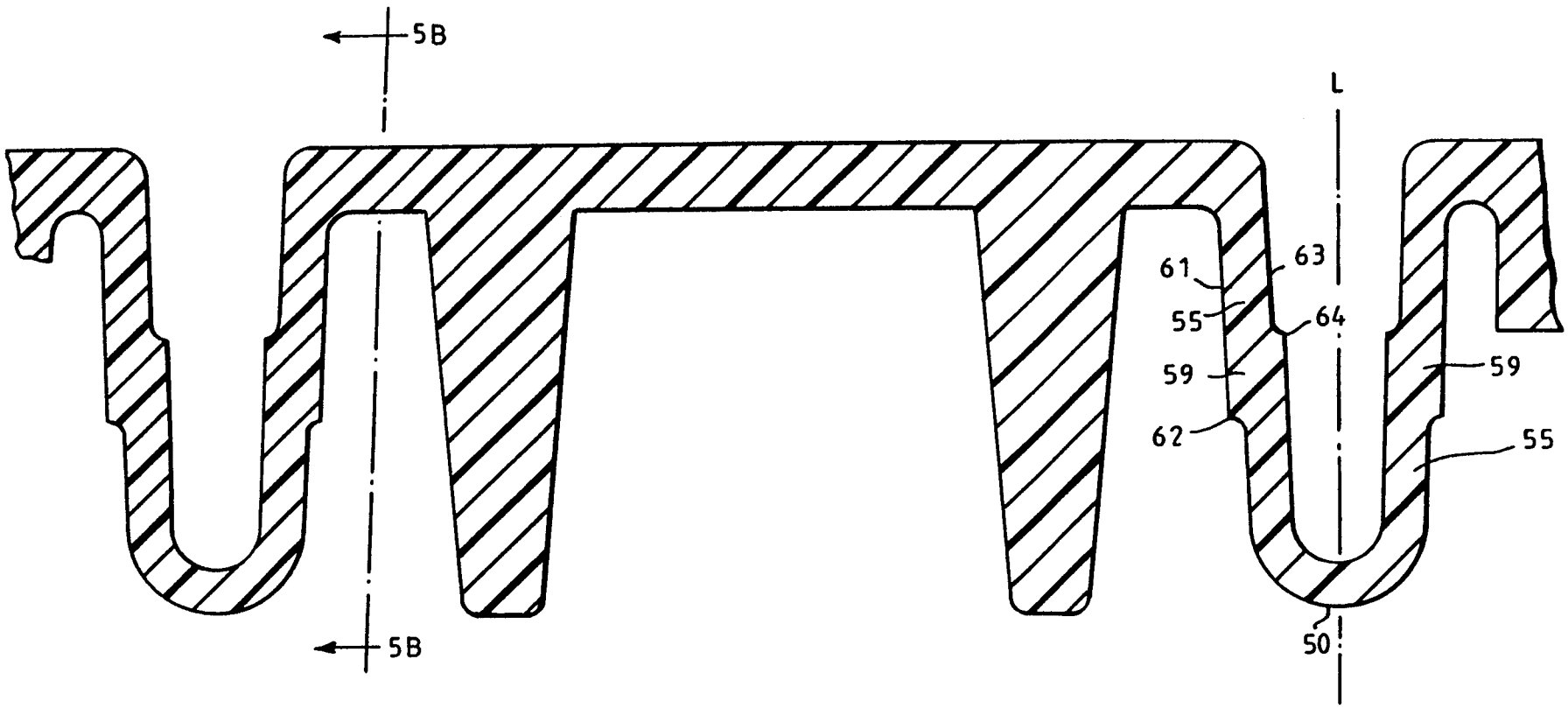
FIG. 5A is a partial rear sectional view of the blade seat of one embodiment of the present invention.

FIG. 5A is a rear-view of a portion of the seat 20 showing the corrugations 24. The corrugations 24 are designed to permit the seat 20 to bend and lengthen in response to the bending forces applied during normal shaving. Each corrugation 24 is formed generally as a continuous U-shape having a longitudinal axis L with a curved bottom portion 50 and generally vertical side walls 55. Disposed approximately midway up the sidewalls 55 of corrugations 24 are increased width portions 59. In the preferred embodiment illustrated in FIG. 5, each corrugation 24 has an outer side edge 61 extending downwardly at an angle of about 1.5 to 3 degrees to a lower ridge 62 preferably disposed below the midpoint of sidewall 55. At lower ridge 62, the outer side edge slopes further inwardly, i.e. toward axis L, thereby reducing the width of the sidewall 55. The inner edge 63 of lateral sidewall 55 also extends downwardly at an angle of about 1.5 to 3 degrees until reaching an upper ridge 64 preferably disposed above the midpoint of sidewall 55. At ridge 64 the edge extends further inwardly, i.e. toward axis L, thereby increasing the width of sidewall 55. Sidewall 55 of this embodiment, therefore, has an increased width portion 59 extending vertically from upper ridge 64 to lower ridge 62 having a greater width than the remainder of the sidewall 55. It will be appreciated by those skilled in the art that this greater width portion enhances the flexibility of corrugation 24 by facilitating the relative flexing of the portions of sidewall 55 above upper ridge 64 and below lower ridge 62 relative to the increased width portion 59. If the sidewall had a constant thickness without ridges, substantially all of the flexing of corrugation 24 would occur at curved bottom portion 50, and, to a lesser degree, at the top of corrugation 24 where sidewalls 55 meet the horizontal portion of seat 20.

The sidewalls 55 and curved bottom portion 50 preferably have a thickness of about 0.010–0.013 inches, while the increased width portions 59 preferably have a thickness of 0.014–0.018 inches. Thus, the corrugations enhance the stretchability of corrugation 24 and decrease the amount of force needed to stretch seat 20 during shaving.

In an alternative embodiment, the sidewall of a corrugation simply has an upper portion and a lower portion having different widths. The flexibility of this alternative embodiment is greater than a corrugation designed with a uniform thickness but less than the embodiment illustrated in FIG. 5A.

Figure 5B:
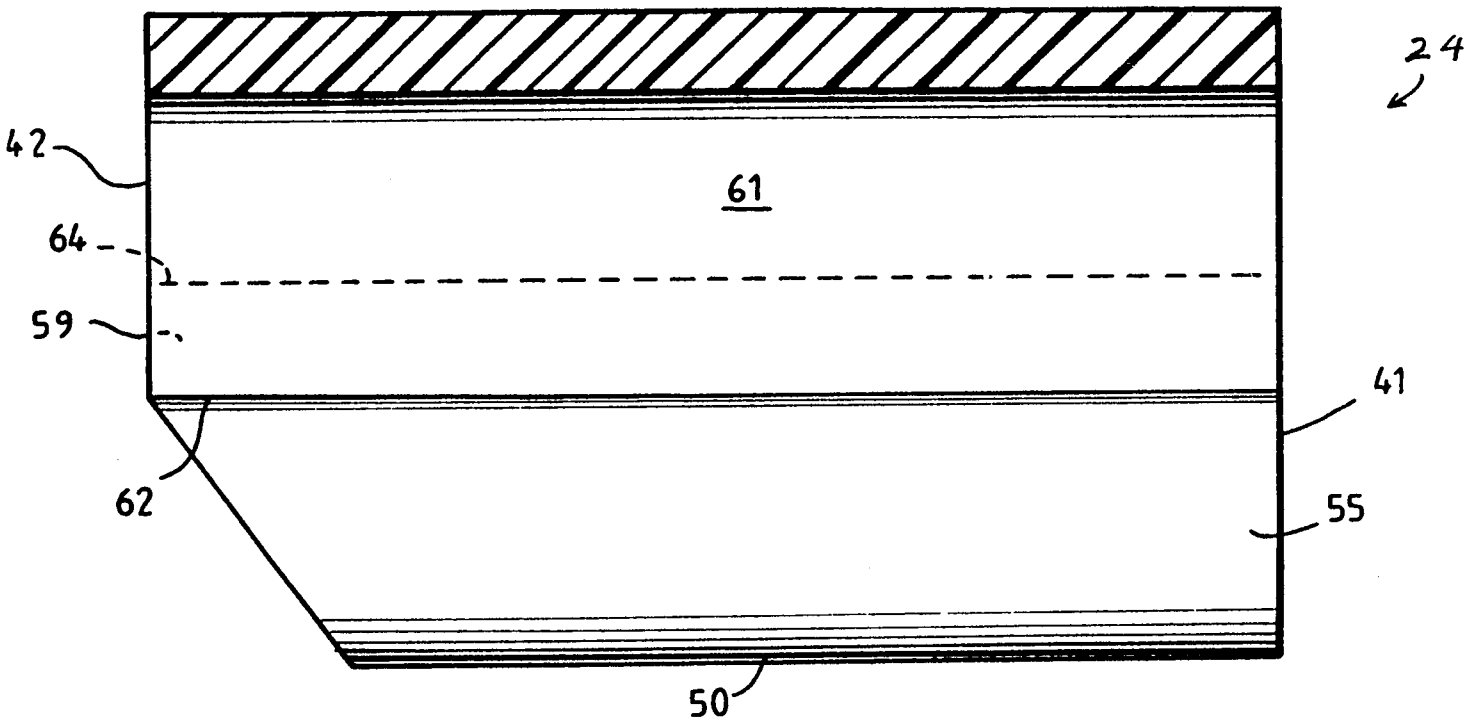
FIG. 5B is a side-view of a corrugation of a blade seat of one embodiment of the present invention.

With reference to FIG. 5B, corrugation 24 has a front side 41 disposed behind guard bar 28 and a rear side 42. Since the flexibility of the bottom curved portion 50 will depend in part upon the length from the front side 41 to the rear side 42, this distance is preferably kept to a workable minimum. As illustrated in FIG. 5B, the rear side 42 advantageously slopes forwardly near curved bottom portion 50 thereby reducing the length of curved bottom portion 50. While the particular length of bottom curved portion 50 may vary, in accordance with the present invention, the curved bottom portion 50 preferably has a length of at least about 0.160, and most preferably at least about 0.175 inches. Unless otherwise stated, all dimensions expressed herein are in inches.

Figure 8:
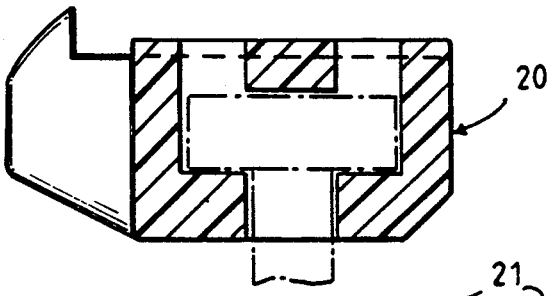
FIG. 8 is a partial, cross-sectional view of the blade seat take along lines 8—8 of FIG. 3.
Figure 9:
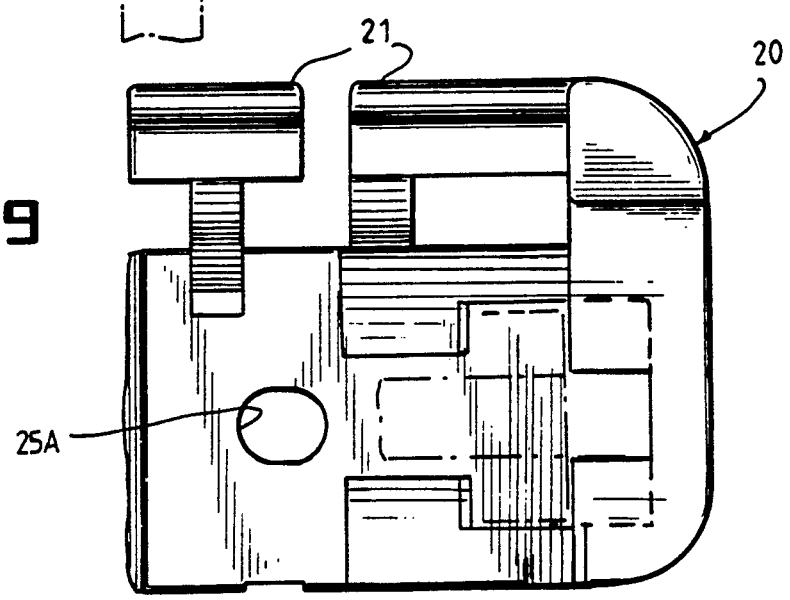
FIG. 9 is a bottom view of an end portion of the blade seat of one embodiment of the present invention.

The attachment of a razor to the razor head of the above-described embodiment of the present invention to a razor handle is preferably by an "inside-out" connection as can best be seen by reference to FIGS. 8 and 9. The razor handle arms (shown only partially in phantom) are adapted to be selectively moveable inwardly during the placement of a razor head on a razor. The razor handle arms are biased outwardly to maintain the shaving arms in an extended "at rest" position in the absence of shaving forces and are preferably deflected inwardly in response to shaving forces. The arms themselves may be resiliently flexible or may be inwardly and/or outwardly biased as desired. The outwardly biased arms are designed to maintain the razor cartridge in a substantially linear configuration in the absence of shaving forces.

The biasing and/or arm flexing provides a limiting means for downward deflection of the central portion of the head. It is preferred that the maximum amount of downward deflection of the razor head at its center point is about 0.120–0.150 in. and, most preferably, about 0.100 –0.120 in.

While the forces required to deflect the razor head of the present invention will depend upon the sizes and materials utilized in forming the individual elements, it is preferred that about 70 to 90 gms. of force are required to achieve a deflection of 0.050 in. in the center of the razor. It is also preferred that the blade package, i.e. the single blade or two blade and spacer combination, should contribute about 10–30% of the gram force needed to obtain a 0.050 in. deflection. The flexibility is enhanced by creating a blade package which flexes in the same locations as the seat and cap and by reducing the amount of material used in forming the individual elements. For example, the slots and holes in the blades and spacer should comprise about 10–20% of the blade and spacer total surface area.

As can be seen particularly by reference to FIG. 2 the seat blade 30' is actually larger than the cap blade. It is particularly preferred that the holes and slots of the seat blade comprise about 10–15% of the total surface area. The cap blade 30 should have openings comprising at least about 15–20% of the total surface area. Deflection values are determined as discussed below.

EXAMPLE 1

The purpose of these tests was to compare the stiffness characteristics of the blade cartridge of this invention and the razor described in the Motta and Cartwright patents referenced above.

Figure 10:
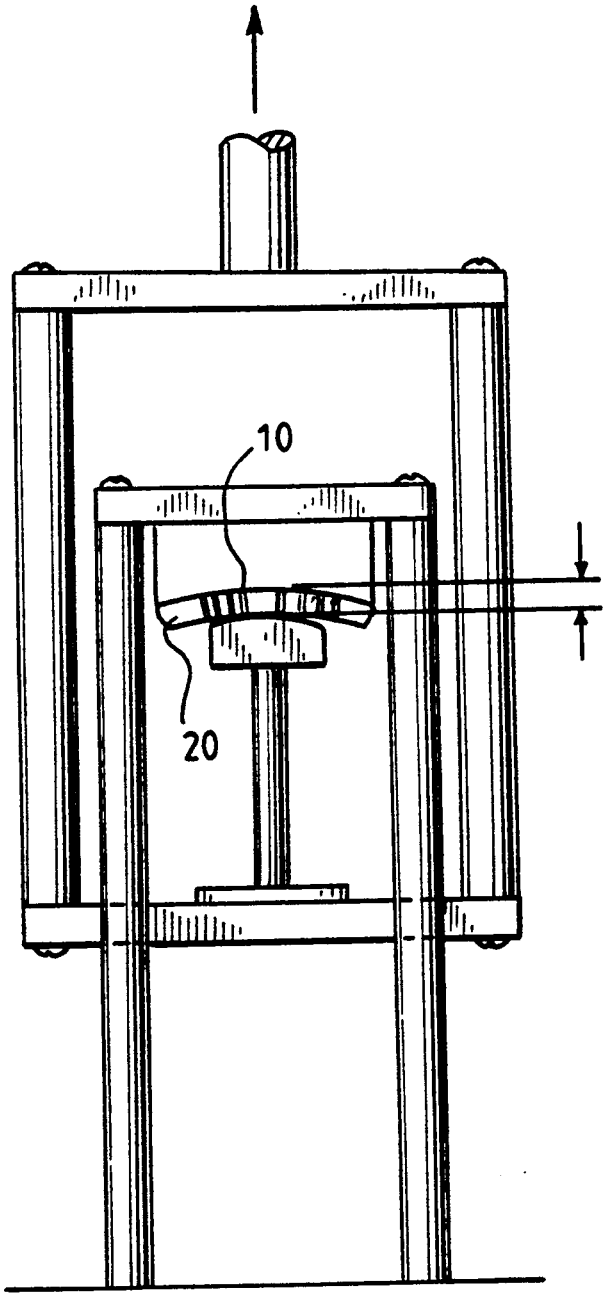
FIG. 10 is illustrative of an Instron test performed on a flexible cartridge of the present invention.

With reference to FIG. 10, the blade cartridge is placed in a fixture which is rigidly attached to an Instron tensile tester base. A ram fixture, as its name depicts, is kinematically mounted to the movable ram of the Instron and is hung from a calibrated load cell. At the bottom of the ram fixture is a pin which applies a load to the blade cartridge in the cartridge holder as the ram fixture moves upward. The purpose of this system is to apply a known deflection to the blade cartridge and simultaneously measure the force.

Tabulated below are the results of such testing of the blade cartridge as well as a blade package made up of two blades and a spacer.

TABLE I

| | Load at .050" | Spring Rate (Calculated) |
|---|---|---|
| Blade Cartridge[1] | | |
| This Invention | 75–85 grams | 1560 grams/inch |
| Cartwright | 39 grams | 760 grams/inch |
| Motta | 155 grams | 3100 grams/inch |
| Blade Package | | |
| This Invention | 13 grams | 260 grams/inch |
| Cartwright | 28 grams | 560 grams/inch |

[1]Blade cartridge consists of blades, spacer, seat and cap.

The comparative data can be summarized as follows:

1. The proposed design of the present invention is stiffer than the Cartwright version.

2. The Motta model is stiffer than either the Cartwright razor or the present invention.

3. The plastic modulus of the plastic used in the Cartwright model was less than 5000 psi in order to achieve the desired stiffness characteristics. The proposed design, however, was tested with a modulus of 400,000 psi. There is, therefore, a great deal of room to modify the stiffness by either reducing the elastic modulus, moment of inertia, or a combination of the two.

According to another embodiment of the present invention, a shaving aid is incorporated into the razor head of the present invention. It will be appreciated by those skilled in the art that the shaving aid can be incorporated by several different methods including attaching or embedding the shaving aid to a portion of the razor head, for example, the raised portions 12 of the cap 10.

Exemplary materials constituting the shaving aid may comprise one or various combinations of the following:

A. A lubricating agent for reducing the frictional forces between the razor head and the skin, e.g., a microencapsulated silicone oil.

B. An agent which reduces the drag between the razor parts and the shaver's face, e.g., a polyethylene oxide in the range of molecular weights between 100,000 and 6,000,000; a non-ionic polyacrylamide; and/or a natural polysaccharide derived from plant materials such as "guar gum".

C. An agent which modifies the chemical structure of the hair to allow the razor blade to pass through the whiskers very easily, e.g., a depilatory agent is one example.

D. A cleaning agent which allows the whisker and skin debris to be washed more easily from the razor parts during shaving, e.g., a silicone polyethylene oxide block copolymer and detergent such as sodium lauryl sulphate.

E. A medicinal agent for killing bacteria, or repairing skin damage and abrasions.

F. A cosmetic agent for softening, smoothing, conditioning or improving the skin.

G. A blood coagulant for the suppression of bleeding that occurs from nicks and cuts.

As has been mentioned hereinabove, the configuration of the shaving aid, its place of application to the razor cartridge, the manner of attachment and/or other means and method of incorporation may vary widely to fit particular requirements.

The elements of the present invention can be formed of materials shown in the art. It is preferred to utilize highly flexible thermoplastic material having high levels of structural integrity. A particularly suitable material is one which is made out of the segmented copolyester elastomer which contains recurring polymeric long chained ester units, derived from dicarboxylic acids and long chain diols and short chain ester units derived from dicarboxylic acids and low molecular weight diols. Suitable materials particularly favored for construction of the cap and seat portions are described in U.S. Pat. Nos. 3,766,146 and 3,651,014 to Witsiepe assigned to E. I. du Pont de Nemours and sold under the tradenames HYTREL 5556 and HYTREL 4056 respectively.

A plastic resilient spacer member may also be formed of these particular polymers in order to enhance the overall flexibility of the razor head of the present invention.

What is claimed is:

1. A flexible razor head comprising:
a cap;
at least one blade;
a seat;
means for securing said cap, blade and seat;
said seat comprising at least one corrugation with a sidewall;
said sidewall having an upper portion, a generally central portion and a lower portion; and
wherein said central portion has a different width than said upper and lower portions.

2. A flexible razor head according to claim 1 wherein said razor comprises two blades separated by a spacer.

3. A flexible razor head according to claim 2 wherein said spacer has cutout portions for receiving said securing means

4. A flexible razor head according to claim 3 wherein said spacer has cutout portions comprising about 10–40% of the surface area of the spacer.

5. A flexible razor head according to claim 1 wherein said securing means comprises a plurality of pins which pass through a corresponding plurality of pin receiving holes in said blade.

6. A flexible razor head according to claim 1 wherein said securing means comprises five pin members.

7. A flexible razor head according to claim 6 wherein said blades are laterally moveable relative to at least one of said pins during the flexing of said razor head.

8. A flexible razor head according to claim 5 wherein said blade has at least one cutout portion positioned between at least two of said pin receiving holes.

9. A flexible razor head according to claim 5 comprising five pins.

10. A flexible razor head according to claim 5 wherein at least one of said pins extends downwardly at least as far as said lower portion of said sidewall.

11. A flexible razor head according to claim 1 wherein means for attaching said razor head to a handle are provided proximate the bottom surface of said seat.

12. A flexible razor head according to claim 11 wherein said attaching means are designed for inside-out attachment.

13. A flexible razor head according to claim 1 wherein said blade has cutout portions comprising about 10–20% of the surface area of the blade.

14. A flexible razor head according to claim 1 wherein at least one of said cap or seat comprise a segmented thermoplastic copolyester elastomer comprising:

(a) recurring polymeric long chain ester units derived from dicarboxylic acids and long chain diols, and (b) short chain ester units derived from dicarboxylic acids and low molecular weight diols.

15. A flexible razor head according to claim 1 wherein said cap, seat and securing means are a single, continuous element.

16. A flexible razor head according to claim 1 wherein a force of about 70–90 gms. is needed to obtain a deflection of 0.050 inches in the central region of said razor head.

17. A flexible razor head according to claim 16 wherein about 10 to 30% of said force needed to obtain said deflection is contributed by said blade.

18. A flexible razor head according to claim 1 wherein the width of said central portion is about 20–50% greater than the width of said lower portion.

19. A flexible razor head according to claim 1 wherein the width of said central portion is about 30–40% greater than the width of said upper portion.

20. A flexible razor head according to claim 1 wherein said cap comprises a plurality of open areas.

21. A flexible razor head according to claim 20 wherein each corrugation is aligned with an open area.

22. A flexible razor head according to claim 21 wherein said open areas comprise holes which extend through said cap.

23. A flexible razor head according to claim 1 further comprising a shaving aid.

24. A flexible razor head comprising:

a cap;

at least one blade;

a seat;

means for securing said cap, blade and seat;

said seat comprising at least one corrugation with a sidewall; and wherein said sidewall comprises at least a first portion and a second portion and wherein the width of said first portion is different from the width of said second portion.

25. A flexible razor head according to claim 24 wherein said cap comprises a plurality of open areas.

26. A flexible razor according to claim 25 wherein each corrugation is aligned with an open area.

27. A flexible razor according to claim 26 wherein said open areas comprise holes which extend through said cap.

28. A flexible razor head according to claim 24 wherein said razor comprises two blades separated by a spacer.

29. A flexible razor head according to claim 24 wherein said securing means comprises a plurality of pins which pass through a corresponding plurality of pin receiving holes in said blade.

30. A flexible razor head according to claim 29 wherein said blade has a cutout portion positioned between at least two of said pin receiving holes.

31. A flexible razor head according to claim 29 comprising five pins.

32. A flexible razor head according to claim 29 wherein at least one of said pins extends downwardly at least as far as said lower portion of said sidewall.

33. A flexible razor head according to claim 24 wherein said blade has cutout portions comprising about 10–20% of the surface area of the blade.

34. A flexible razor head according to claim 24 wherein said spacer has cutout portions for receiving said securing means.

35. A flexible razor head according to claim 34 wherein said spacer has cutout portions comprising about 10–40% of the surface area of the spacer.

36. A flexible razor head according to claim 24 wherein means for attaching said razor head to a handle are provided proximate the bottom surface of said seat.

37. A flexible razor head according to claim 36 wherein said attaching means are designed for inside-out attachment.

38. A flexible razor head according to claim 24 wherein at least one of said cap or seat comprise a segmented thermoplastic copolyester elastomer comprising:

(a) recurring polymeric long chain ester units derived from dicarboxylic acids and long chain diols, and (b) short chain ester units derived from dicarboxylic acids and low molecular weight diols.

39. A flexible razor head according to claim 24 wherein a force of about 70–90 gms. is needed to obtain a deflection of 0.050 inches in the central region of said razor head.

40. A flexible razor head according to claim 39 wherein about 15 to 30% of said force needed to obtain said deflection is contributed by said blade.

41. A flexible razor head according to claim 24 wherein the width of said first portion is about 25–50% greater than the width of said second portion.

42. A flexible razor head according to claim 24 wherein the width of said first portion is about 30–40% greater than the width of said second portion.

43. A flexible razor head according to claim 24 wherein said razor head further comprises a shaving aid.

44. A flexible razor head according to claim 24 wherein said cap, seat and securing means are a single continuous element.

45. A flexible razor head comprising:

a cap having a plurality of open areas;

at least one blade;

a seat comprising at least one corrugation having a sidewall with a first portion of a first width and a second portion with a second width different from said first width;

means for securing said cap, blade and seat such that each corrugation is aligned with an open area of said seat.

46. A flexible razor head according to claim 45 wherein said cap, seat and securing means are a single, continuous element.

47. A flexible razor head according to claim 45 comprising a shaving aid.

* * * * *